United States Patent [19]

Kong

[11] Patent Number: 4,831,694

[45] Date of Patent: May 23, 1989

[54] BUCKLE HAVING EXTERNAL FINGER GRIP

[75] Inventor: Alan Kong, Yokohama, Japan

[73] Assignee: Nifco, Inc., Yokohama, Japan

[21] Appl. No.: 119,467

[22] Filed: Nov. 10, 1987

[30] Foreign Application Priority Data

Nov. 11, 1986 [JP] Japan ..... 61-173260

[51] Int. Cl.[4] ..... A44B 11/25

[52] U.S. Cl. ..... 24/625; 24/606; 24/615; 24/635

[58] Field of Search ..... 24/606, 615, 616, 631, 24/632, 633, 635, 664

[56] References Cited

U.S. PATENT DOCUMENTS

| | | | |
|---|---|---|---|
| 807,069 | 12/1905 | Geoffroy | 24/616 X |
| 1,177,272 | 3/1916 | Robbins | 24/616 X |
| 1,414,838 | 5/1922 | Street | 24/606 |
| 4,012,155 | 3/1977 | Morris | 24/625 X |
| 4,246,680 | 1/1981 | Gray | 24/606 |
| 4,672,725 | 6/1987 | Kasai | 24/625 |
| 4,679,282 | 7/1987 | Feng | 24/615 X |
| 4,694,544 | 9/1987 | Chapman | 24/625 |

FOREIGN PATENT DOCUMENTS

| | | | |
|---|---|---|---|
| 250716 | 11/1966 | Austria | 24/635 |
| 130196 | 7/1919 | United Kingdom | 24/606 |

*Primary Examiner*—Kenneth J. Dorner
*Assistant Examiner*—Laurie K. Cranmer
*Attorney, Agent, or Firm*—Schwartz & Weinrieb

[57] ABSTRACT

A side-release type buckle is provided with a sliding member arrangement that enables the buckle to be easily released using only one hand, even if the engagement of the two parts of the buckle are being subjected to a strong pulling force in the direction of disengagement. The sliding member or grip is slidably mounted upon the exterior of the female member and includes laterally inwardly directed tapered surfaces for encountering engaging bars of the male member lockingly engaged with engagement edge portions of the female portion so as to disengage the engaging bars of the male member from the engagement edge portions of the female member when the slidable grip member is moved axially along the female member.

20 Claims, 3 Drawing Sheets

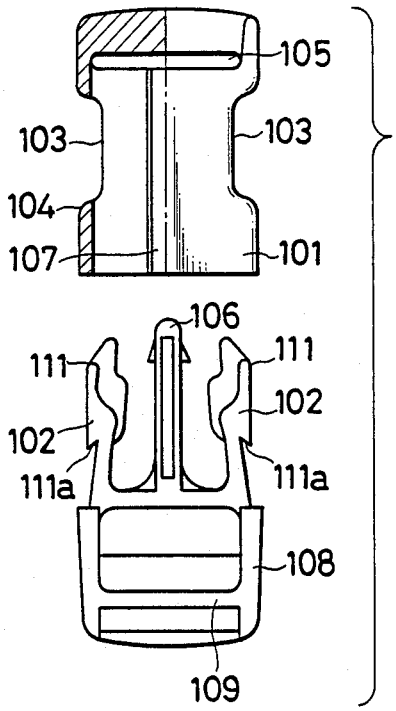
FIG. 1
PRIOR ART
FIG. 2
PRIOR ART
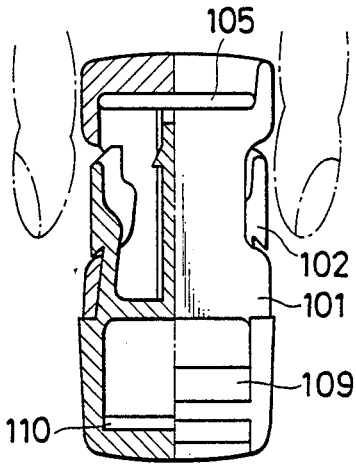

BUCKLE HAVING EXTERNAL FINGER GRIP

FIELD OF THE INVENTION

The invention relates to an improved side-release type buckle comprising a male member consisting of a pair of resilient engaging bars, each provided on the outer side thereof with a hook portion, and a female member formed in a flat cylindrical shape.

BACKGROUND OF THE INVENTION

Various types of side-release type buckles have been proposed. A typical one of such conventional buckles, described with reference to FIGS. 1 and 2, is comprised of a female member consisting of a flat cylindrical portion 101 and, a male member provided with a pair of engaging bars 102 which in a compressed state are inserted into the female member. The cylindrical portion 101 of the female member has a pair of laterally recessed sidewall portions having through-openings 103 provided in symmetrical opposition upon each side thereof, with an edge 104 of each opening 103 forming an engaging edge. Also, generally the female member is provided with a fixing slit 105 for a belt or the like at the end opposite to the end within which the male member is inserted. Also, an inner surface of the cylindrical member 101 is further provided with a guide groove 107 for mated engagement with a guide bar 106 of the male member.

The male member is provided with a pair of engaging bars 102 that extend integrally from a frame 108, one on each side of the guide bare 106. A fastening strip 109 such as a belt or the like is secured upon the frame 108 by means of an angled slit 110. Each of the engaging bars 102 has a hook portion 111 on the outer mutually opposed sides, and a barb 111*a* formed upon the bases side of the hook portion 111 that engages with the edge 104 of each of the openings 103 of the female member.

In the exemplary conventional buckle, the engaging bars 102 of the male member are brought slightly inwardly toward each other so as to press them into the interior of the female cylindrical portion 101, the elastic deformation of the bars 102 permitting insertion of the same into the female member so that the hook portions 111 can subsequently protrude outwardly from the openings 103 whereby the barbs 111*a* of the hook portions 111 engage the edges 104, binding the two members together.

In the conventional buckle, in order to disengage the members the cylindrical member 101 is gripped with one hand while the other hand is used to squeeze the hook portions 111 of the engaging bars 102 laterally inwardly toward the inner part of the cylindrical portion 101 so the barbs 111*a* of the hook portions 111 disengage from the edges 104 of the openings 103.

As a result, the unbuckling operation requires the use of both hands, and in addition it is necessary to push the hook portions 111 in the direction in which the male member is withdrawn from the female member at the same time that the hook portions 111 are being pushed laterally inwardly toward the inside of the cylindrical portion 101, making the unbuckling operation complex and difficult. Such a buckle is therefore not suitable for operation by young children and is also unsuitable for use as a buckle that may require emergency unbuckling.

In particular, there have been drawbacks such as when a male-female buckle is simply engaged and the male-female parts are not subjected to tension in mutually separating directions, there is required in addition to the buckling disengagement operation a further male-female separation-direction operation. Still further, in the instance where the male-female buckle members are being subjected to oppositely directed pulling forces or tension, the barbs 111*a* of the hook portions 111 are strongly engaged with the edges 104 of the openings 103, making it difficult to press the hook portions 111 laterally inwardly toward the inside of the female member and through the opoenings 103.

OBJECT OF THE INVENTION

An object of this invention is to eliminate the aforementioned drawbacks of the conventional buckle by providing an improved buckle which facilitates the operation of releasing the engagement of the male and female members both when the male and female members are in a non-tensioned state of engagement and when they are in a state of engagement under a strong tension force.

SUMMARY OF THE INVENTION

To attain this object, the buckle according to the present invention comprises:

a female member comprised of a flat cylindrical portion having mutually-opposed top and bottom walls and side walls, and an engaging opening in at least one part of the two side walls of the cylindrical portion;

a male member provided with a pair of resilient engaging bars that make sliding contact with the inner surface of the two side walls of the female member when inserted therein and which are each provided on the outer mutually opposed sides thereof with a hook portion that engages with an edge portion of the sidewalls defining the openings;

and an operating grip attached to the female member so as to be slidable upon the cylindrical portion so as to cover at least one part of the engaging opening in each side wall of the cylindrical portion;

the outer side of each of the engaging hook portions of the male member protruding outwardly from the engaging opening of the female member so as to be compressed laterally inwardly by means of the inner surface of the operating grip sliding over the engaging openings.

The hook portions of the male member engaging bars inserted into and engaged with the female member are therefore pressed laterally inwardly toward the inside of the female cylindrical member by moving the operating grip attached to the female member across the female member openings so as to disengage the barb portions from the edge portions of the openings, and by further movement of the operating grip and consequent laterally inward movement of the hook portions of the male member, each one of the hook portions of the male member is disengaged from the edge portions of the female member whereby the male member can be withdrawn from the female member.

Thus, with the buckle according to this invention, by simply sliding the operating grip in the direction of the engaged male member, the male and female members are disengaged, thereby enabling the disengagement opertion to be carried out with just one hand.

As described above, with the buckle according to the present invention the unbuckling operation is facilitated, and even when no tension is being exerted up on the male and female members the buckle can be readily disengaged.

Moreover, even when the male and female members are in strong engagement in the direction in which tension is being exerted, the inexpediencies such as the difficulty of pressing the hook portions of the male member laterally inwardly into the cylindrical member, and also the difficulty of releasing the hook portions of the male member from the pushed-in state because with the disengagement of the hook portions from the edge portions of the openings the hook portions are suddenly pushed into the cylindrical member, are eliminated by means of a simple sliding operation of the operating grip, enabling the disengaging operation of the buckle to be performed easily and effectively.

In case where the hook portions of the male member have been pushed into the cylindrical member directly by means of the finger tips and it has been difficult to move the two hook portions equal distances unto the female member, especially when a stron pull is being exerted upon the male and female members, faulty disengagement has sometimes occurred. However, the operating grip causes equal amounts of pressure to be exerted upon the hook portions while at the same time producing lateral forces directed toward the inside of the cylindrical member that enables the buckle to be smoothly disengaged.

BRIEF DESCRIPTION OF THE DRAWINGS

Other objects and features of the invention will be understood from the following description, which is made with reference to the accompanying drawings, wherein:

FIG. 1 is a partly sectional plan view of a conventional buckle in a disengaged state;

FIG. 2 is a partly sectional plan view showing the buckle of FIG. 1 in an engaged state;

DESCRIPTION OF THE PREFERRED EMBODIMENTS

Figure 3:
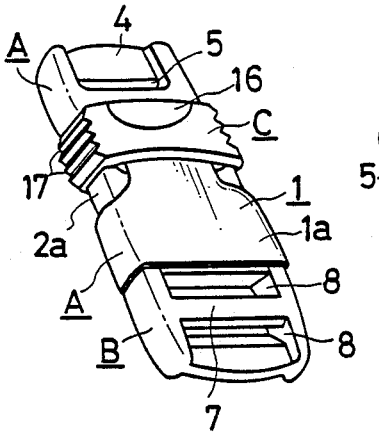
FIG. 3 is a perspective view of an embodiment of a buckle according to the present invention, shown in an engaged state.
Figure 4:
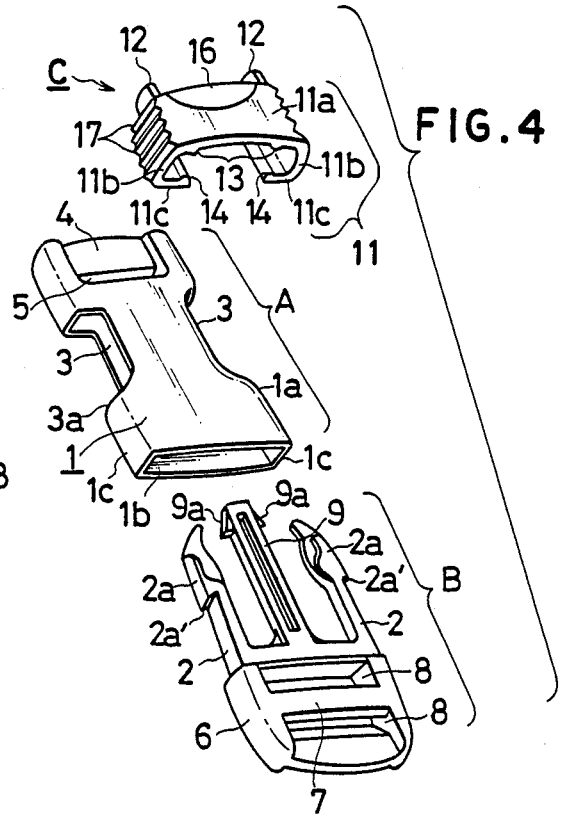
FIG. 4 is an exploded perspective view of the buckle of FIG. 3 in a disengaged state.
Figure 5:
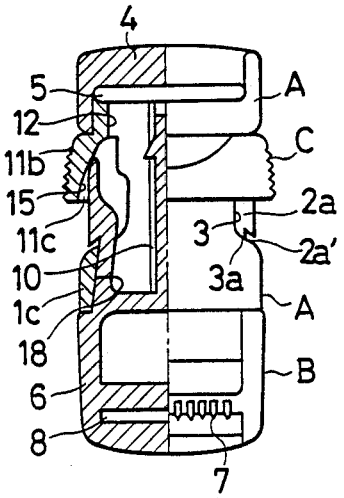
FIG. 5 is a partly sectional plan view of the buckle of FIG. 3 in an engaged state.

With reference to FIGS. 3 to 5 that show a preferred embodiment of a buckle according to the present invention, the buckle is comprised of a male member B, a female member A and an operating grip C. From considerations of ease of manufacture, resilience and the imparting of deformability and the like, preferably injection-molding techniques are used to form these structural components in from plastic materials.

The female member A is an approximately flat cylindrical member 1 comprised of a top wall 1*a*, a bottom wall 1*b* and side walls 1*c*. One end of the cylindrical member 1 forms an opening for the insertion of a male member B to be engaged therein, while the other end is provided with a fastening portion 4 spanning the space between the side walls 1*c*, the fastening portion being provided to affix a belt or the like thereto by means of a slit 5. Formed within the side walls 1*c* at diametrically opposed positions are openings 3, the openings 3 being formed by cutting out part of the top wall 1*a* and bottom wall 1*b*. The shape of each opening 3 is appropriately decided in accordance with the shape of the male member B. The edge 3*a* of each of the openings 3 nearest to the open end of the cylindrical member 1 forms the edge for engagement with the male member B.

The male member B has a frame 6 that forms a loop attachment portion for a belt or the like and which is provided with a loop bar 7 and angle slots 8. The frame 6 is also provided with a guide bar 9 that extends axially from the central portion of the frame 6, and with a pair of engaging bars 2 flanking the guide bar 9, the bars 9 and 2 being located in the same plane. The engaging bars 2 are provided at their end portions with hook portions 2a on the sides opposite to the sides of the bars that face each other, and barbs 2*a'* are provided toward the base part of the hook portions 2*a*. The tip portion of the guide bar 9 is provided with projections 9*a* arranged for engagement with a guide groove provided inside the female cylindrical member 1.

The operating grip C is in the shape of a truncated ring 11 comprised of a top wall portion 11*a*, side wall portions 11*b*, and a cutout bottom wall portion 11*c*.

The operating grip C is formed so that it curves over the top wall 1*a* of the cylindrical member 1 of the female member A, the side wall portions 11*b* being positioned so as to partially block the openings 3 while the bottom wall portions 11*c* are in contact with the lower surface of the bottom wall 1*b* of the female member A. As a result, the operating grip C is attached to the cylindrical member 1 so that it covers a part of the openings 3 of the female member A and is slidable only within the area of the opening 3.

The operating grip C is securely attached to the cylindrical portion of the female member A so that its sliding operation can be performed smoothly and positively, and is provided at the end disposed adjacent to fastening portion 4 with guide projections 12 that slide along the inner surfaces of the side walls 1*c* of the cylindrical member. Also provided upon the inner surface of the top wall portion 11*a* of the operating grip C is a pair of ridges 13 that contact the edge portions of the female member openings 3, while provided upon the upper edge of each bottom wall portion 11*c* is a raised lip 14 that engage with guide grooves (not shown) formed upon the lower surface of the bottom wall 1*b* of the female member A, the secure functioning of the grip C being ensured by the sliding action of the aforenoted structural members.

Inner walls 15 of the operating grip C side wall portions 11*b* are tapered toward the ends having guide projections 12 so as to compress the hook portions 2*a* of the male member B, each tapered wall 15 serving to cause the hook portions 2*a* of the inserted engaging bars 2 tgo be resiliently deformed laterally inwardly. Although in this embodiment the wall 15 is tapered, it may be suitably designed to have a different shape in accordance with the shape of the hook portions 2*a* to be disengaged thereby. For example, instead of a taper each wall may instead just be provided with a projecting portion that engages with each hook portion 2*a*.

To facilitate the sliding action of the operating grip C, a depression 16 is formed at the end of the top wall portion 11*a* disposed adjacent the projections 12, the depression 16 being provided so as to locate a finger for exerting pressure in order to slide the operating grip C, the side wall 11*b* also being provided with non-slip ridges, serrations, or corrugations.

In the buckle of the above construction, when the engaging bars 2 of the male member B are inserted into the cylindrical portion 1 of the female member A, the engaging bars 2 are pushed laterally inwardly towards each other as they advance along the inner surfaces 18 see FIG. 5, of the side walls 1*c* of the cylindrical member 1, so that when the hook portions 2*a* reach the openings 3, the hook portions 2*a* resiliently return to their normal unbiased positions so as to project outwardly through the openings 3 whereby the barbs 2*a'* of the hook portions 2*a* engage with the edges 3*a* of the openings 3 (FIG. 5). By tapering the inner surfaces 18 of the side walls 1*c* so the diametrical extent defined between the oppositely disposed inner surface 18 becomes less as one proceeds in the axial direction of insertion from the entrance of the cylindrical portion 1 of the female member, the resilient engagement of the hook portions 2*a* with the edges 3*a* is enhanced. Such structure also enhances the smoothness of the disengagement, as when the barbs 2*a'* are disengaged from the edges 3*a*, the resilient force of the hook portions 2*a* acting against the tapered surfaces 18 facilitating the withdrawal.

Figure 6:
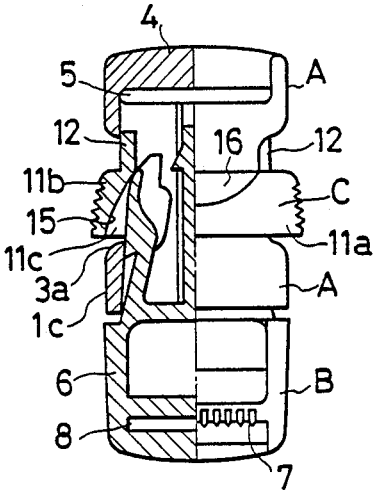
FIG. 6 is a partly sectional plan view of the buckle of FIG. 3 in a state of imminent disengagement.

With the male and female members thus engaged, by sliding the operating grip C along the female member A from the position shown in FIG. 5 to that shown in FIG. 6, the tapered walls 15 of the operating grip C press the hook portions 2*a* of the engaging bars 2 inwardly, gradually deforming the engaging bars 2 so as to produce a disengagement of the barbs 2*a'* from the edges 3*a*, following which the tapered walls 15 push the hook portions 2*a* in the direction of egress of the male member B, resulting in a smooth and positive withdrawal of the engaging bars 2 from the cylindrical member 1 (FIG. 4) and the complete extraction of the male member B from the female member A.

Figure 7:
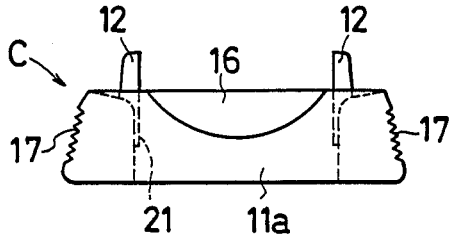
FIG. 7 is a plan view of another embodiment of the operating grip of the buckle shown in FIG. 3.
Figure 8:
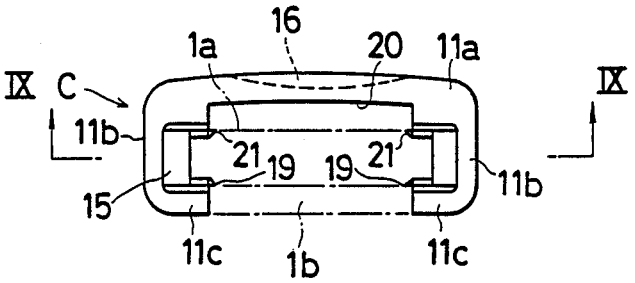
FIG. 8 is a side view of the operating grip shown in FIG. 7.
Figure 9:
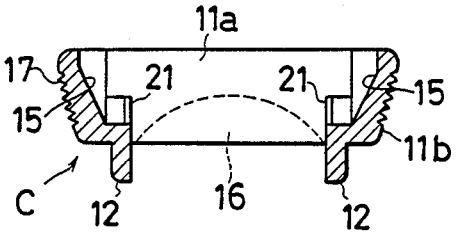
FIG. 9 is a sectional view along the line IX—IX shown in FIG. 8.

Another embodiment of the operating grip will now be described with reference to FIGS. 7 to 9. This operating grip C is substantially similar in construction to the operating grip C described in the foregoing, except for slight improvements to the structure of the bottom wall portion 11*c* and the inner surface of the top wall portion 11*a*. Specifically, the bottom wall portions 11*c* are provided so as to be contiguous with guide projections 12, the extra space being used as the operating space for the hook portions 2*a* of the engaging bars 2, and inward-facing ridge 19 being provided on each upper edge of the opposed faces of the bottom wall portions 11*c*, the arrangement of the ridges 19 being such that they press against the inner surface of the bottom wall 1*b* of the cylindrical member 1 of the female member A.

Also, the inner side of the top wall portion 11*a* of the operating grip C is provided with a wide channel 20 which receives the top wall 1*a* of the cylindrical member 1. Ridges 21 are provided symmetrically upon the edges of the channel 20 at positions corresponding to the ridges 19, so that the ridges 21 press against the inner surface of the cylindrical member top wall 1*a*.

As a result, the operating grip C mounted upon the female cylindrical member 1 is supported upon the inner surfaces of the edges of the openings 3 by means of the ridges 19 and 21, in addition to which the top wall 1*a* of the cylindrical member 1 slides within the channel 20, providing a stable sliding operation.

As is clear from the foregoing explanation, with the buckle according to this invention the male and female members can be disengaged by means of a simplified a sliding operation, an operation which can be done securely even using only one hand.

Obviously, many variations and modifications of the present invention can be made in light of the above teachings. It is therefore to be understood that within the scope of the appended claims, the present invention may be practiced otherwise than as specifically described herein.

What is claimed is:

1. A buckle, comprised of:

a female member formed as a substantially flattened tubular member having mutually-opposed top and bottom walls, and a pair of mutually opposed side walls, and an engaging opening, having an engagement edge portion, provided within each of said side walls;

a male member provided with a pair of resilient engaging bars that making sliding contact with an inner surface of each of said two side walls of said female member when said male member is inserted into said female member, said engaging bars each being provided upon an outer side surface thereof with a hook portion that projects laterally outwardly through a respective one of said engaging openings of said female member so as to be engaged with said engagement edge portion of said engaging openings of said female member when said male member is disposed at an engaged position within said female member; and an operating grip member slidably mounted upon the exterior of said female member in an annularly surrounding manner with respect to said substantially flattened tubular female member so as to be axially slidably upon said substantially tubular female member between a first position at which said engaging openings of said female member are substantially uncovered such that said engaging hook portions of said male member protrude outwardly through said engaging openings of said female member so as to be engaged with said engagement edge portions of said female member, and a second position at which said engaging openings of said female member are substantially covered by said operating grip member such that inner surfaces of said operating grip member encounter said hook portions of said engaging bars so as to force said hook portions laterally inwardly through said engaging openings and into the interior of said female member so as to be disengaged from said engagement edge portions of said female member.

2. A buckle as set forth in claim 1, wherein:

said hook portions of said male member include barb portions for engaging said engagement edge portions of said female member.

3. A buckle as set forth in claim 1, wherein:

said inner surfaces of said grip member are tapered laterally inwardly in the axial direction of insertion of said male member with respect to said female member.

4. A buckle as set forth in claim 1, wherein:

said female member includes slot means, defined within an end portion thereof opposite an end portion thereof through which said male member is inserted, for receiving one end of a belt upon which said buckle is to be disposed; and said male member includes slot means, defined within an end portion thereof opposite an end portion thereof which is to be inserted within said female member, for receiving an opposite end of said belt upon which said buckle is to be disposed.

5. A buckle as set forth in claim 1, wherein:

said grip member has a substantially C-shaped cross-section.

6. A buckle set forth in claim 1, wherein:

said operating grip member is slidably disposed upon a substantially central portion of said female member.

7. A buckle as set forth in claim 1, wherein:

said engaging bars of said male member extend axially from opposite side portions of said male member.

8. A buckle as set forth in claim 1, wherein:

finger depression means are defined within an exterior surface of said operating grip for facilitating said axial movement of said operating grip between said first and second positions.

9. A buckle as set forth in claim 1, wherein:

said operating grip is provided with corrugated finger gripping means for facilitating said axial movement of said operating grip between said first and second axial positions.

10. A buckle as set forth in claim 1, wherein:

said operating grip includes ridge means for cooperating with said female member in order to guidingly facilitate said axial movement of said operating grip member upon said female member between said first and second positions.

11. A buckle, comprising:

a first substantially flattened tubular female member having opposed top and bottom walls; opposed side walls with an engaging opening, and an engaging edge portion, being defined within each one of said sidewalls; and an insertion opening defined within a first end of said female member;

slot means defined within a second opposite end of said female member for receiving one end of a belt member upon which said buckle is to be secured;

a second male member having a pair of flexible hook means for insertion into said female member through said insertion opening thereof and for projecting laterally outwardly through said engaging openings of said female member such that said hook means are engaged with said engaging edge portions of said female member;

slot means defined within an end portion of said male member, which is disposed opposite an end portion thereof upon which said hooks means are disposed, for receiving a second end of said belt member upon which said buckle is to be secured; and a third grip member slidably mounted upon said female member between said first and second ends thereof for movement between a first position at which said grip member is substantially disengaged from said hook means of said male member so as to permit said hook means of said male member to protrude laterally outwardly through said sidewall openings of said female member and engage said engagement edge portions thereof, and a second position at which said grip member is engaged with said hook means of said male member so as to force said hook means of said male member laterally inwardly of said female member for disengagement from said engagement edge portions of said female member.

12. A buckle as set forth in claim 11, wherein:

said grip member is slidably disposed upon a substantially central portion of said female member between said first and second end portions thereof having said insertion opening and slot means defined therein.

13. A buckle as set forth in claim 11, wherein:

said grip member comprises a substantially flattened tubular member mounted upon said female member in an annularly surrounding disposition.

14. A buckle as set forth in claim 13, wherein:

said grip member has a substantially C-shaped cross-section.

15. A buckle as set forth in claim 11, wherein:

said hook means include barb sections for engagement with said engaging edge portions of said female member.

16. A buckle as set forth in claim 11, wherein:

inner surface portions of said grip member are tapered laterally inwardly in the axial direction of insertion of said male member with respect to said female member.

17. A buckle as set forth in claim 11, wherein:

said flexible hook means extend axially from opposite side portions of said male member.

18. A buckle as set forth in claim 11, wherein:

said grip member is provided with finger depression means within an exterior surface thereof for facilitating said movement of said grip member between said first and second positions.

19. A buckle as set forth in claim 11, wherein:

said grip member is provided with corrugated finger gripping means for facilitating said movement of said grip member between said first and second positions.

20. A buckle as set forth in claim 11, wherein:

said grip member is provided with ridge means for cooperating with said female member in order to guidingly facilitate said movement of said grip member upon said female member between said first and second positions.

* * * * *